US005709060A

United States Patent [19]

Vaughan et al.

[11] Patent Number: 5,709,060

[45] Date of Patent: Jan. 20, 1998

[54] CONCRETE FORMING SYSTEM WITH BRACE TIES

[75] Inventors: Jamieson R. Vaughan, Omaha; Jay D. Williamson, Papillion, both of Nebr.; Kenneth M. Blom, Kansas City, Mo.

[73] Assignee: I.S.M., Inc., Paola, Kans.

[21] Appl. No.: 413,417

[22] Filed: Mar. 30, 1995

Related U.S. Application Data

[63] Continuation-in-part of Ser. No. 334,146, Nov. 4, 1994.

[51] Int. Cl.[6] ..... E04B 2/34; E04B 2/40

[52] U.S. Cl. ..... 52/426; 52/427; 52/428; 52/565; 52/568; 52/604; 52/605; 52/607; 52/693

[58] Field of Search ..... 52/426, 427, 428, 52/565, 568, 712, 105, 309.11, 309.12, 592.1, 592.6, 604, 605, 607, 657, 693

[56] References Cited

U.S. PATENT DOCUMENTS

| | | | |
|---|---|---|---|
| 880,820 | 3/1908 | Pierson . | |
| 1,871,318 | 8/1932 | Greenwood . | |
| 3,778,020 | 12/1973 | Burrows et al. . | |
| 3,788,020 | 1/1974 | Gregori . | |
| 3,872,636 | 3/1975 | Nicosia . | |
| 3,922,828 | 12/1975 | Patton . | |
| 3,979,867 | 9/1976 | Sowinski . | |
| 4,223,501 | 9/1980 | DeLozier . | |
| 4,516,372 | 5/1985 | Grutsch . | |
| 4,698,947 | 10/1987 | McKay . | |
| 4,706,429 | 11/1987 | Young . | |
| 4,730,422 | 3/1988 | Young . | |
| 4,731,968 | 3/1988 | Obino . | |
| 4,750,308 | 6/1988 | McKay . | |
| 4,765,109 | 8/1988 | Boeshart . | |
| 4,879,855 | 11/1989 | Berrenberg . | |
| 4,884,382 | 12/1989 | Horobin . | |
| 4,889,310 | 12/1989 | Boeshart . | |
| 4,916,879 | 4/1990 | Boeshart | 52/426 |
| 5,065,561 | 11/1991 | Mason . | |

*Primary Examiner*—Christopher T. Kent
*Attorney, Agent, or Firm*—Chase & Yakimo

[57] ABSTRACT

A form tie for joining the sidewalls of a polymeric concrete form comprises a pair of end trusses with an intermediate web truss. Each end truss comprises an interior vertical strut and a longer exterior strut with interior and exterior pairs of horizontal struts extending therebetween. Upper and lower rectangular trusses and an intermediate truss are formed within each truss and rigidified by diagonal struts extending between the ends of the exterior vertical strut and interior vertical strut. The exterior struts of each end truss are coplanar with the exterior sidewall surface with the interior strut of each end truss being coplanar with the interior sidewall surface. The coplanar relationship of the struts serve as a visual gauge that the form with tie has been properly manufactured and assures that the end trusses extend throughout the width of each sidewall. End ties having a height of one-half of the form sidewall are extended between the sidewalls at the ends of each form. The end ties of adjacent forms are vertically offset to enhance concrete flow therebetween. During transport and use the trusses resist the presence of compression, tension, twisting and other forces acting on the forms so as to maintain the desired spatial relationship between the forms. A seat for horizontal rebar is found with each form tie.

11 Claims, 14 Drawing Sheets

CONCRETE FORMING SYSTEM WITH BRACE TIES

CROSS REFERENCE TO RELATED APPLICATION

This application is a continuation-in-part of application Ser. No. 08/334,146, filed Nov. 4, 1994.

BACKGROUND OF THE INVENTION

This invention relates to a concrete forming system and, more particularly, to novel form ties for maintaining the sidewalls of a concrete form in desired longitudinal, vertical and laterally spaced-apart relationships.

Concrete forms made of a polymeric foam material are known. One such form is shown in U.S. Pat. No. 3,788,020, issued on Jan. 29, 1974. This patent discloses a concrete form with a pair of sidewalls, end walls and intermediate partition walls. A plurality of these forms are connected to present vertical cavities for pouring concrete therein to form a plurality of vertical concrete columns or piers. These vertical columns are connected by a horizontal concrete beam formed by filling a channel with concrete, the channel presented upon placing one row of concrete forms atop another.

One problem with these concrete forms is that the sidewalls must be immobilized so as to resist pressures on the walls during transport and, more importantly, during concrete pouring and curing. If not, the form sidewalls may shift in lateral and/or vertical and/or longitudinal directions. Such displacements make it difficult to easily connect the forms. Also, the forms may separate along the joints respectively presented along the zones of connection between longitudinally and vertically adjacent forms. If not sufficiently braced the concrete can cause these joints to separate. The industry refers to such separations as "blow outs".

Accordingly, various devices in the forms of braces and permanent tension members have been proposed so as to maintain the sidewalls in place to preclude such shifting and/or "blow outs" during concrete pouring and subsequent curing. However, such devices have been relatively complex in construction requiring the sidewalls to have special configurations so as to receive the braces and/or ties.

In response thereto we have invented novel ties for reinforcing concrete forms which effectively interface with the form sidewalls so as to maintain the walls in a desired spatial relationship during transport as well as concrete pouring and curing.

Each form tie generally comprises a pair of end trusses with an intermediate web truss spanning the form sidewalls. The trusses are formed by a pair of vertical end struts with a pair of horizontal struts spanning the upper and lower ends of the vertical struts. A second pair of interior vertical struts and horizontal struts are spaced from the perimetrical struts to form a plurality of secondary rectangular trusses. First and second diagonal struts rigidify the trusses. The end trusses are embedded in the sidewalls of the forms during the molding process with the intermediate web truss spanning the facing interior surfaces of the sidewalls. The ties preclude lateral, vertical and longitudinal shifting of the sidewalls during transport and use. The ties utilized adjacent the ends of the form sidewalls are halved so as to not interfere with concrete flow between longitudinally adjacent concrete forms.

An alternate embodiment of the form tie also comprises a pair of end trusses with an intermediate truss spanning the form sidewalls. The exterior vertical end strut of each end truss extends above and below the end truss. During form molding these end struts are positioned adjacent the exterior surface of each sidewall and cooperate with the smaller interior vertical end strut to reinforce the form sidewall of the concrete form extending between the struts. Diagonal struts extend between the upper and lower ends of the exterior vertical struts and interior vertical struts so as to further reinforce the trusses and form sidewalls. End ties utilized adjacent the ends of the form sidewalls are approximately one-half the height of the primary tie so as to allow concrete flow between forms.

It is therefore a general object of this invention to provide a novel concrete form tie for use in a concrete forming system.

A further object of this invention is to provide a concrete form tie, as aforesaid, which is incorporated in the concrete form during the blow molding thereof.

Another general object of this invention is to provide a concrete form tie, as aforesaid, which resists loads that impart tension, compression, bending, twisting and lateral stresses acting thereon.

Still a further object of this invention is to provide a concrete form tie, as aforesaid, which diminishes the lateral, vertical and longitudinal displacement of adjacent sidewalls of a concrete form during transport and use.

A still more particular object of this invention is to provide a concrete form tie, as aforesaid, which presents a plurality of reinforcing trusses within and between the sidewalls of a concrete form.

A further particular object of this invention is to provide a concrete form tie with trusses, as aforesaid, which are reinforced by diagonal struts extending therethrough.

Another particular object of this invention is to provide a concrete form tie, as aforesaid, which enhances on-site assembly of the concrete forms.

A further object of this invention is to provide a concrete form tie, as aforesaid, which does not interfere with concrete flow through the form sidewalls and between adjacent forms.

Another particular object of this invention is to provide a concrete form tie, as aforesaid, which effectively precludes seepage of the polymeric foam from the form mold during the molding process.

A further particular object of this invention is to provide a concrete form tie, as aforesaid, which presents a pair of end trusses anchored in each sidewall of a polymeric foam with a web truss defining the lateral distance between the form sidewalls.

Still a more particular object of this invention is to provide a concrete form tie with end trusses, as aforesaid, the latter having a vertical strut coplanar with the interior surface of a form sidewall to indicate a proper distance between the form sidewalls.

Another particular object of this invention is to provide a concrete form tie with end trusses, as aforesaid, the latter having a vertical strut anchoring the end truss in a form sidewall.

Other objects and .advantages of this invention will become apparent from the following description taken in connection with the accompanying drawings, wherein is set forth by way of illustration and example, now preferred embodiments of this invention.

DESCRIPTION OF THE PREFERRED EMBODIMENT

Figure 1:
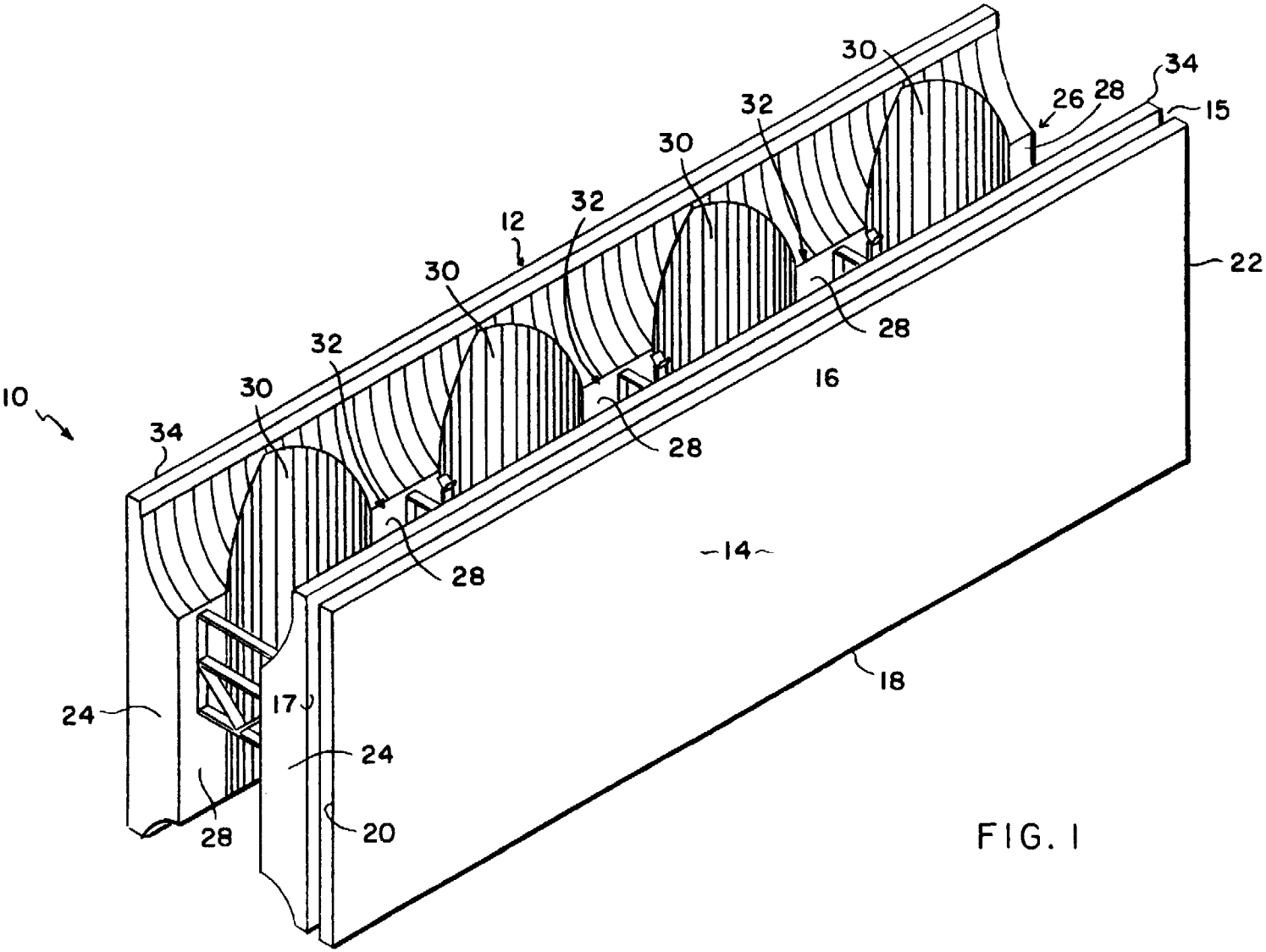
FIG. 1 is a perspective view of a plurality of concrete form ties spanning first and second sidewalls of a concrete form.

Turning more particularly to the drawings, FIG. 1 shows one type of concrete form 10 as generally comprising a pair of sidewalls 12, 14. Each sidewall has upper 16 and lower 18 longitudinal edges as well as a pair of opposed vertical edges 20, 22. The form 10 further includes a pair of longitudinally displaced end walls 24, 26 with intermediate longitudinally spaced-apart partition walls 28. The sidewalls 12, 14, end walls 24, 26 and partition walls 28 cooperate to form a plurality of vertical cavities 30 and a vertical slot 32 between the facing surfaces of the end walls 24, 26 and partition walls 28. Slot 32 longitudinally spans the length of the form 10 and connects the cavities 30. Each form 10 has tongues 34 along the respective upper 16 edges which mate with complementary grooves 36 located along the lower edges of an overlying form 10.

At one end the end walls 24 extend beyond the sidewalls. At the opposed end the sidewalls 12, 14 extend beyond the end wall 26. Thus, lap joint surfaces are formed. The sidewall extensions 15 at one end of one form overlap the end wall extensions 17 of an adjacent form when joined in a longitudinally adjacent relationship. Accordingly, the forms 10 may be connected in longitudinally extending courses and stacked one atop the other.

Although not shown it is understood that the first course of forms are positioned atop a footing and held in place by various materials such as plastic roof cement. It is understood that other types of connection of the first row of forms to the footing may be utilized such as placing the forms in a wet footing and allowing the footing to subsequently dry. Upon reaching a desired height of the form courses wet concrete is poured between the form sidewalls 12, 14. (It is understood that the forms are staggered among rows so as to preclude formation of a continuous vertical joint among the form rows.) The poured concrete fills the vertical cavities 30 and longitudinally extending vertical slot 32 of each form. Also, upon stacking a second course of forms atop the first a horizontal channel is formed which spans the upper and lower forms. The poured concrete will fill the channel of the form. Thus, a concrete wall within slot 32, concrete piers within cavities 30 and a horizontal beam of concrete within the channel is presented. The forms 10 are left in place for insulating the resulting concrete wall. Wall clips 900 are shown for attaching exterior siding thereto. Such clips 900 are the subject of a separate patent application.

It is known that the courses of the forms may be selectably configured so as to present walls of various configurations. Also, door frames, window frames, bucks, bulkheads, and the like may interrupt the courses of forms so as to provide openings for insertion of doors, windows and the like therein while precluding spillage of poured concrete from the forms.

During the pouring of the concrete a hydraulic concrete load acts on the sidewalls 12, 14 of each form 10 as well as on any structure spanning such sidewalls 12, 14. The load urges the sidewalls 12, 14 from their proper vertical, lateral and longitudinal spatial relationships. Also during form transport to the job site, the sidewalls 12, 14 may be displaced due to the weight of other forms stacked thereon. In some cases the distance between the sidewalls 12, 14 may vary. Accordingly, problems will arise when attempting to longitudinally and vertically connect forms as the mating lap joint surfaces and/or tongue/groove elements will not be properly aligned.

Figure 4:
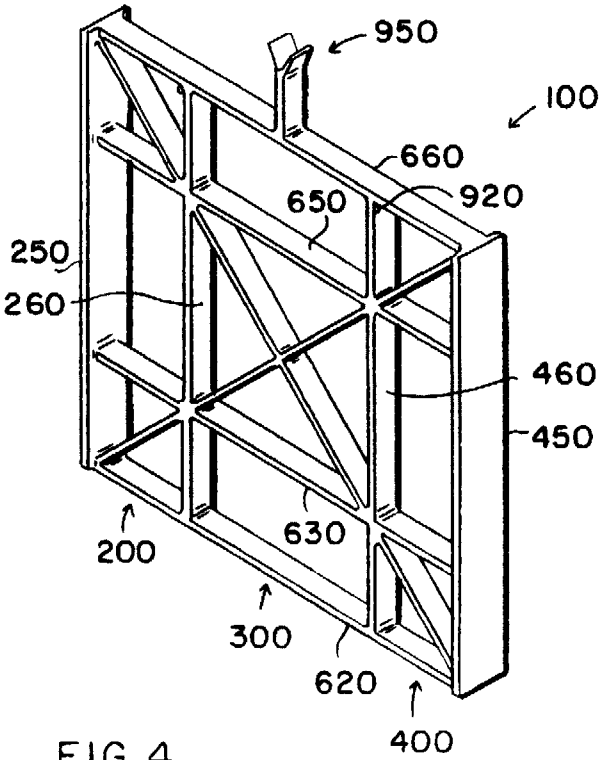
FIG. 4 is a perspective view of the form tie of FIG. 3.
Figure 3:
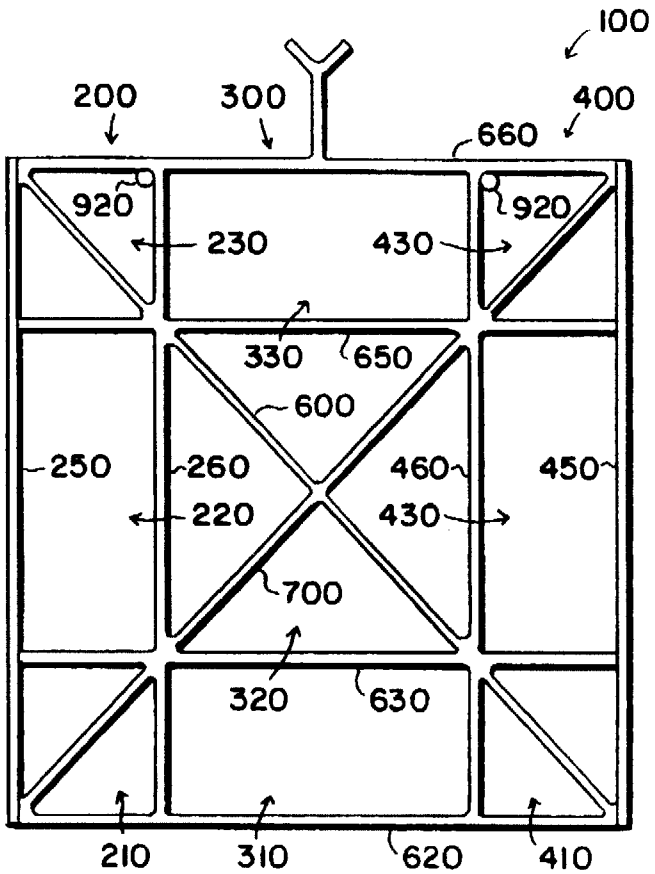
FIG. 3 is a plan view of the concrete form tie shown in FIGS. 1 and 2 on an enlarged scale.

As best shown in FIGS. 3 and 4 each tie 100 presents an overall square configuration. The tie comprises first 200 and second 400 laterally spaced-apart end trusses with an intermediate web truss 300 therebetween. Each end truss 200, 400 generally comprises a first vertical strut 250, 450 with a second vertical strut 260, 460 laterally displaced therefrom. A pair of horizontal struts 620, 660 extend between the lower and upper ends of the end struts 250, 450 and intermediate vertical struts 260, 460. The combination of these horizontal and vertical struts presents the primary rectangular configuration to the end trusses 200, 400 and intermediate web truss 300.

Vertically displaced from the respective horizontal struts 620, 660 are a second pair of horizontal struts 630, 650. These struts 630, 650 cooperate with the above-described struts to present upper, lower and intermediate trusses within each primary truss 200, 300, 400. The respective end trusses 200, 400 thus have lower and upper rectangular trusses 210, 230, 410, 430 with intermediate trusses 220, 420. The web truss 300 presents lower and upper trusses 310, 330 with intermediate truss 320.

A pair of diagonal struts 600, 700, extend between the primary opposed corners of the tie 100 to provide overall rigidity thereto. As seen in FIGS. 3 and 4, the diagonal struts 600, 700 also extend through the lower 210, 410 and upper 230, 430 sections of the end trusses 200, 400 and the central section 320 of the web truss 300.

Two bipartite molds are used for forming the sidewalls 12, 14 of the polymeric concrete form 10. Polystyrene beads are blown into the respective sidewall molds at a first temperature with the beads expanding upon cooling so as to fill the mold. Upon the beads being reheated at an elevated temperature, a second expansion occurs so that the foam fills the mold. Upon removal of the mold the sidewalls are presented.

One problem which has arisen with the use of form ties is that the sidewall molds must have openings therein to allow for insertion of the ends of the tie in each mold and extension of the tie between the sidewall molds. In turn, the expanding foam may escape from these mold openings. Such a leakage/seepage of the foam from the mold may impair form integrity and lead to undesirable ruptures, cracks, etc. in the forms. Such defects may not be visibly apparent until the form sidewalls are subjected to the hydraulic loads presented by the poured concrete between the form sidewalls 12, 14.

Figure 2:
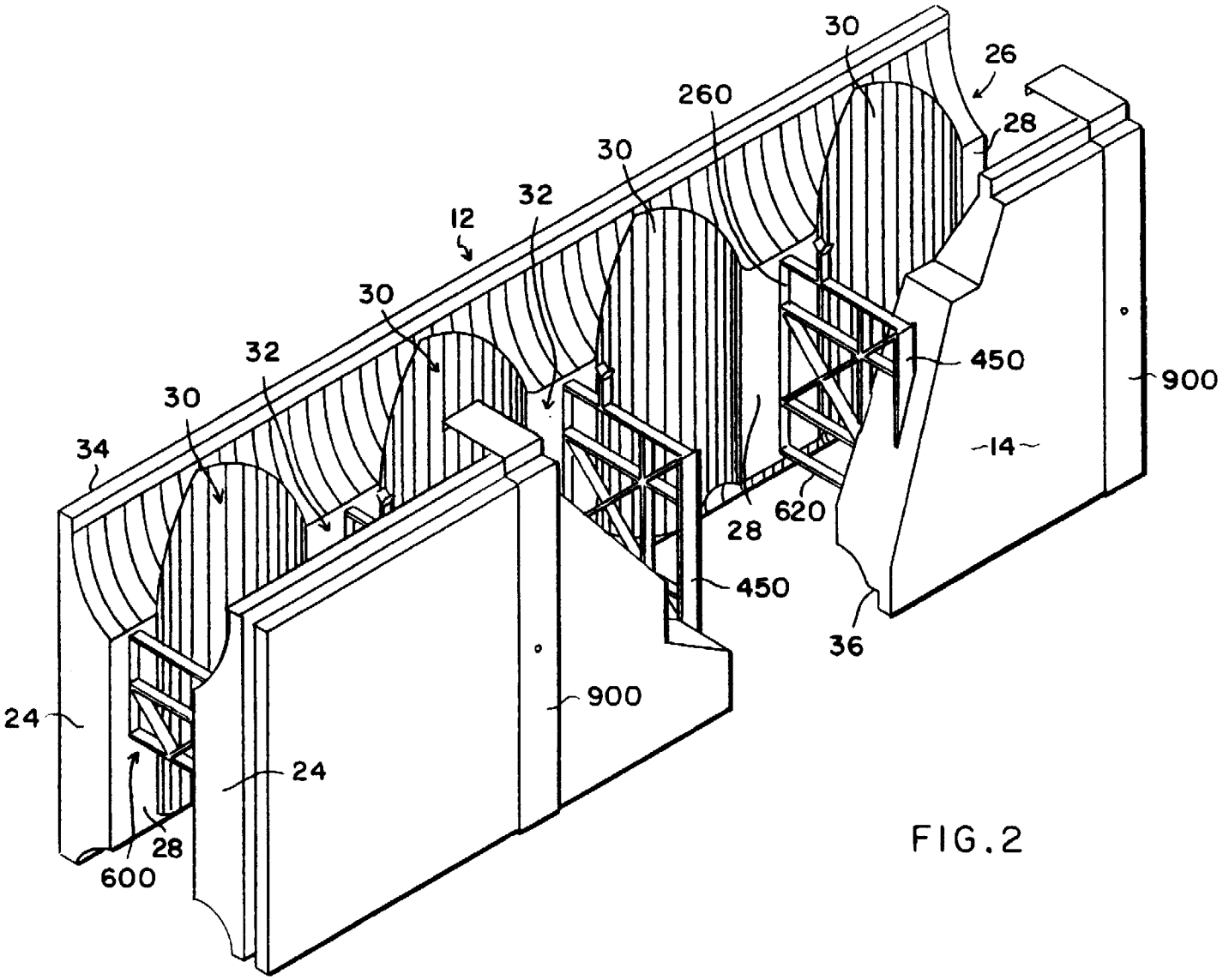
FIG. 2 is a perspective view of the form of FIG. 1 with a portion of one sidewall of the form broken away to show the concrete tie embedded within the sidewall of the form.
Figure 12:
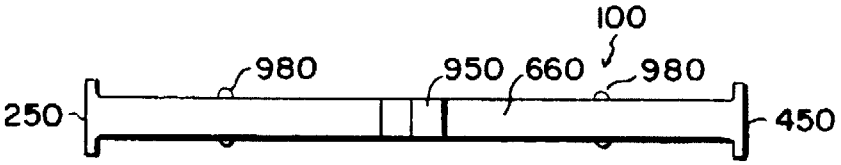
FIG. 12 is a top view of the tie of FIG. 3.

In response to such a problem the interior vertical struts 260, 460 are configured to seal the mold openings. (Also shown are a plurality of nipples 980 which act as guides to assist the mold operator in aligning the tie 100 within the mold openings.) Thus, the struts 260, 460 preclude escape of the expanding polystyrene foam from the mold. The results of a proper sealing are as shown in FIGS. 1 and 2 as the opposed faces of these struts 260, 460 are not covered by foam. Also, the distance between these interior struts 260, 460 define the width of the intermediate web 300 and thus the resulting lateral displacement between the sidewalls 12, 14. Accordingly, the coplanar relationship of the opposed, interior faces of the strut 260, 460 with the interior faces of the partition walls 28 present a visual gauge of a common lateral displacement between the sidewalls 12, 14 of all forms. If not, i.e. the strut extends below or beyond the sidewalls, the form 10 sidewalls 12, 14 have an undesirable lateral displacement and should be discarded prior to use.

Thus, the intermediate web 300 fixes and maintains a desired lateral distance between the facing vertical surfaces of the partition sidewalls 28 of the form 10. This common lateral modularity assures the builder that the stacked forms 10 will present even exterior surfaces as presented by the exterior surfaces.

As best shown in FIG. 2, the end trusses 200, 400 are embedded in the sidewalls 12, 14 of the form. As such the end trusses 250, 450 are centrally embedded within the respective sidewall 12, 14 to resist any forces acting thereon which may disrupt the monolithic structure of the sidewall. The web 300 spans the sidewalls 12, 14 with the intermediate truss 320 being rigidified by diagonals 600, 700. As such, a plurality of trusses 310, 320, 330 extend between the sidewalls so as to maintain the distance therebetween in the presence of hydraulic concrete loads. It is noted that the struts of the trusses are so arranged so as to present a minimal amount of surface to a longitudinal concrete flow through the form 10.

Figure 6:
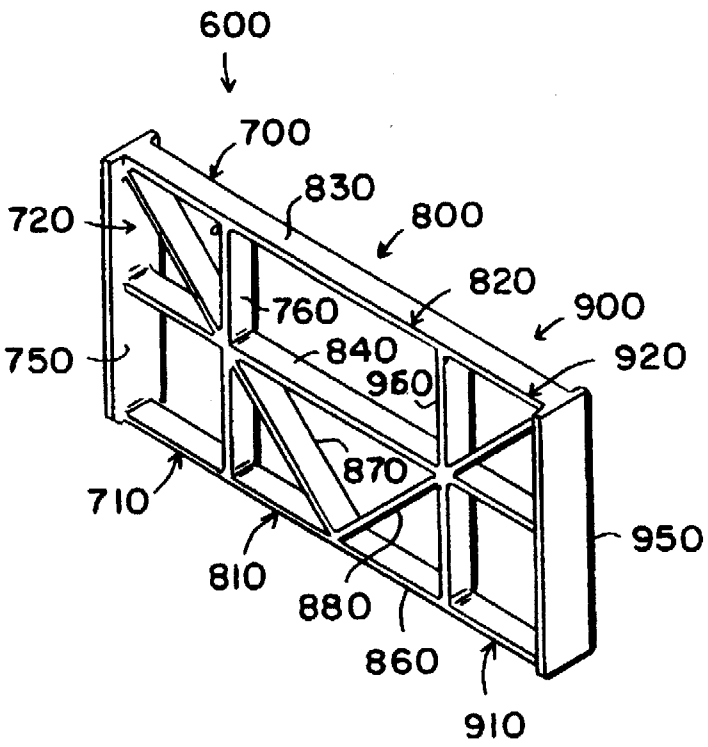
FIG. 6 is a perspective view of the concrete tie of FIG. 5.
Figure 13:
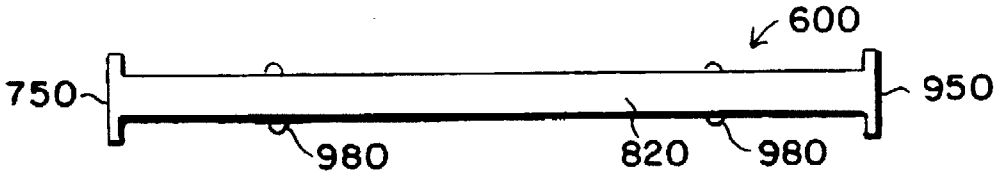
FIG. 13 is a top view of the tie of FIG. 5.
Figure 5:
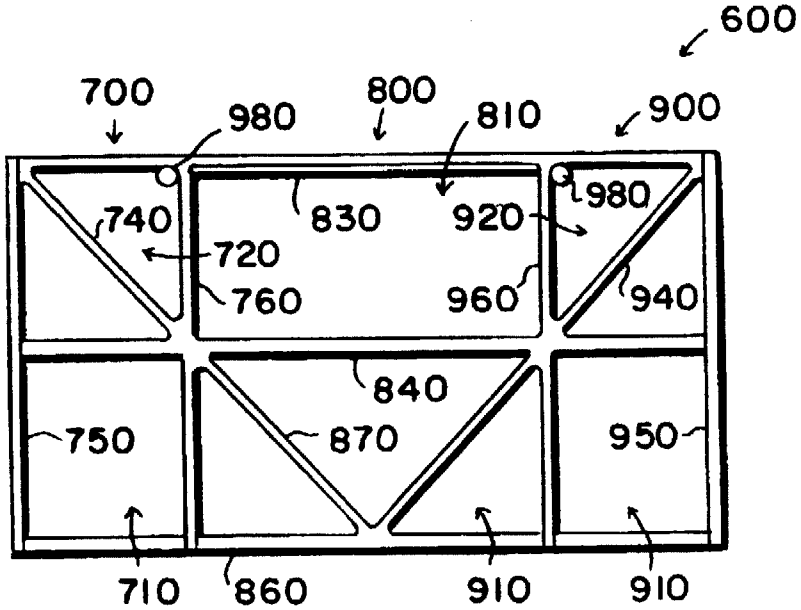
FIG. 5 is a plan view of an alternative form of the concrete tie for use adjacent the ends of a concrete form.
Figure 8:
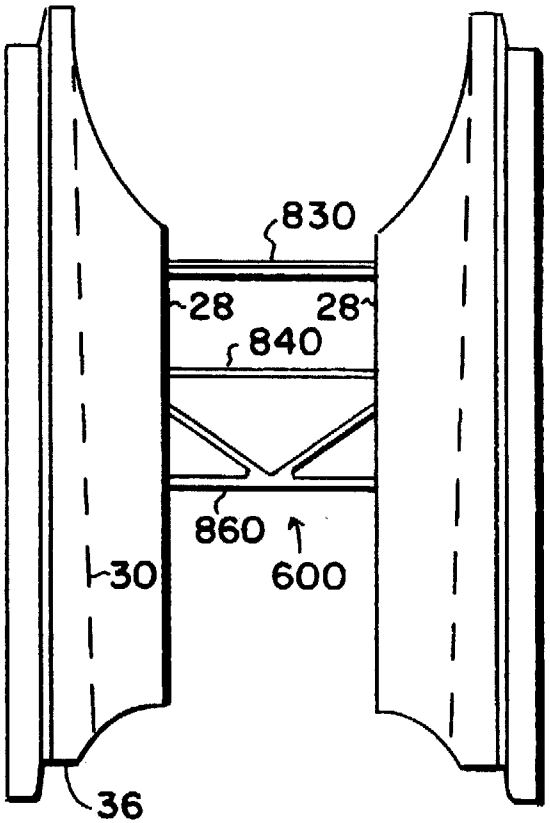
FIG. 8 is an end view of one end of the concrete form of FIG. 9.
Figure 7:
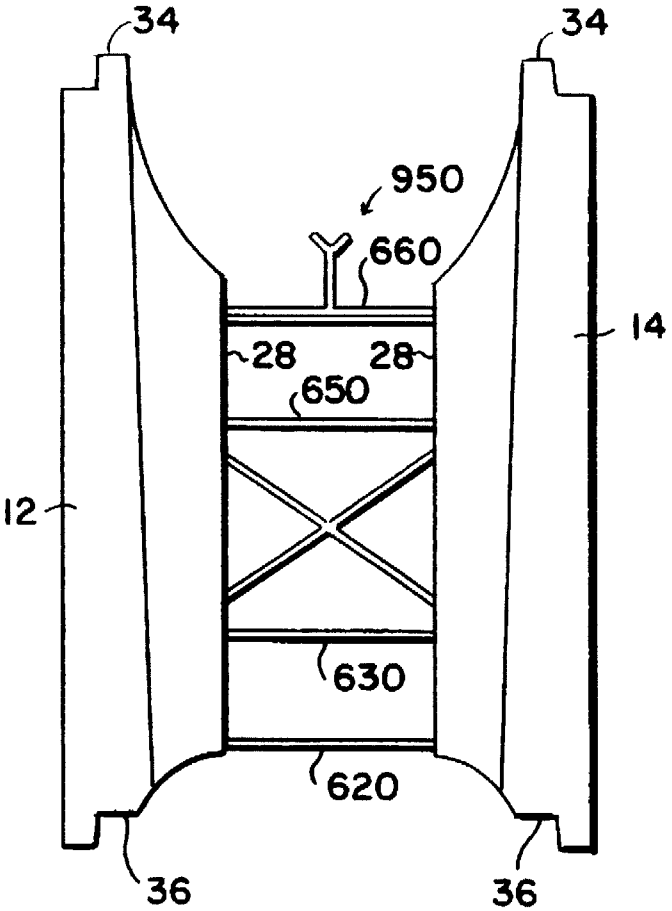
FIG. 7 is a section view taken along lines 7—7 in FIG. 9.

End ties 600 are as shown in FIGS. 5 and 6 and are approximately one-half the height of the primary tie 100. Each end tie 600 comprises first 700 and second 900 end trusses with an intermediate web 800. Each end truss 700, 900 comprises a first vertical strut 750, 950 with a second vertical strut 760, 960 laterally displaced therefrom. A pair of horizontal struts 830, 860 extend between the lower and upper ends of the end struts 750, 950 and intermediate vertical struts 760, 960. An intermediate horizontal strut 840 extends between the vertical struts. The struts, as above described, present the primary trusses 700, 800, 900. Each end truss 700, 900 further presents lower 710, 910 and upper 720, 920 trusses. The web 800 also has lower 810 and upper 820 truss sections.

A diagonal strut 740, 940 extends between the opposed corners of the upper end trusses 720, 920. Diagonal struts 870, 880 extend from the upper corners of the lower web truss 810 and towards the midpoint of the lower horizontal strut 860.

Figure 9:
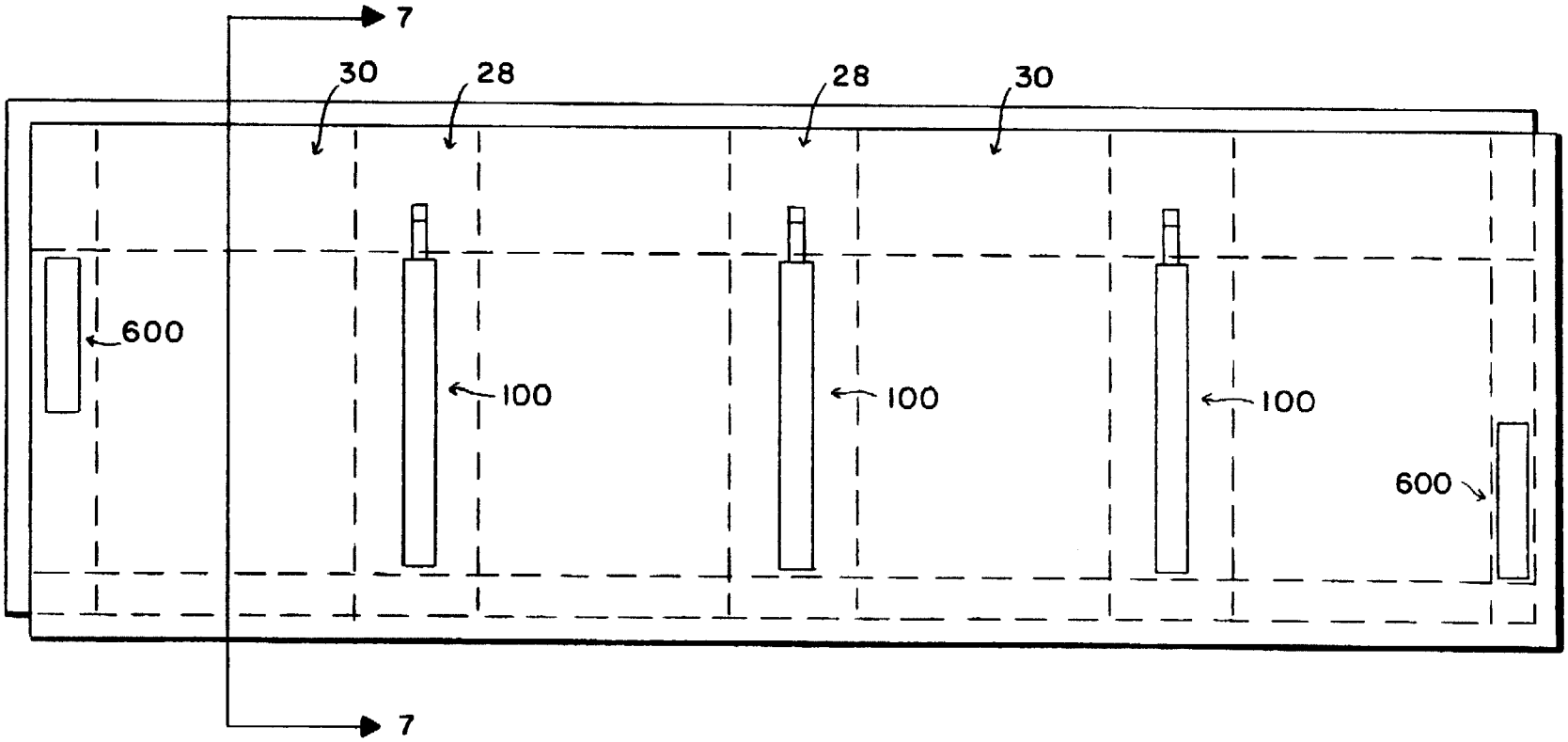
FIG. 9 is a side view of the concrete form with the phantom lines defining the various cavities and form ties therein.
Figure 10:
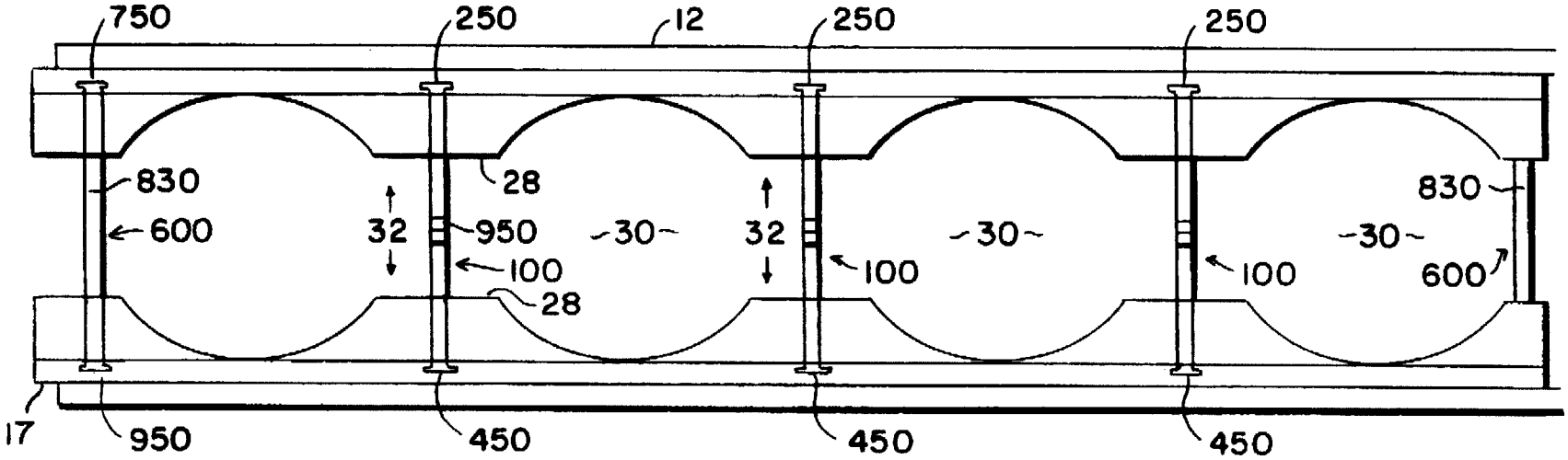
FIG. 10 is a top view of the concrete form of FIG. 9.
Figure 11:
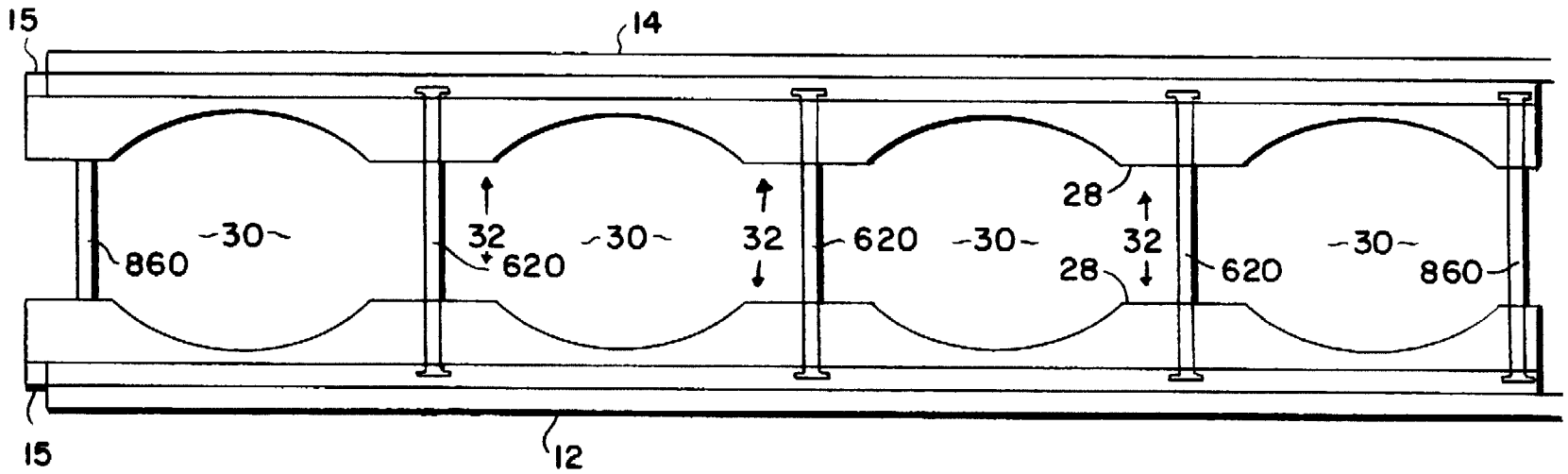
FIG. 11 is a bottom view of the forms of FIG. 9.

As shown in FIGS. 1 and 9 the top strut 830 of end tie 600 is aligned with the top strut 660 of a tie 100 at one end of the form 10. At the opposed end of the form the bottom strut 620 of tie 600 is aligned with the bottom strut 860 of a tie 100 to present a vertical offset therebetween. Upon a first form 10 being connected with a longitudinally adjacent second form, a pair of form ties 600 will be longitudinally adjacent but vertically offset from one another. These vertically offset ties 600 are utilized in lieu of ties 100 to preclude the restriction of concrete flow between longitudinally adjacent forms 10. Also, the end ties 600 found at the vertical joint formed by connected forms strengthens this vertical joint so as to diminish "blow out" therealong.

The primary and secondary rectangular trusses of the ties 100, 600, as above described, resist tension, compression, bending, twisting and lateral forces acting thereon during transport as well as during concrete pouring and curing.

Such trusses are further reinforced by the diagonal struts extending therethrough. These diagonal struts enhance the maintenance of the overall configuration of the tie, the primary 200, 300, 400 trusses and the secondary trusses therein. Moreover, the portions of the diagonal struts, as embedded in the form material, present additional bearing surfaces resistant to the various pressures presented by the poured concrete. Thus, the vertical, lateral and longitudinal forces acting on the form faces during transport and subsequent use are resisted so as to maintain the desired spatial relationships/modularities of the form sidewalls 12, 14.

The relatively larger width of the outside 250, 450 struts presents an enlarged bearing surface to the surrounding foam. This relationship not only resists twisting of the form 100 in the face of longitudinal stresses acting thereon but enhances the resistance against pressures resulting from the concrete poured between the form sidewalls 12, 14. Thus, longitudinal shifting of the sidewalls 12, 14 of the form 10 is particularly precluded. Such preclusion also contributes to the elimination of reduction in the width modularity during form use.

Tie 100 presents a seat 950 extending from the upper horizontal strut 660 for receiving a portion of horizontal rebar (not shown) therein. Upon rebar placement vertical rebar is extended through the respective cavities, offset from the centerline and tied to the horizontal rebar.

An alternative tie 1100 for use with the form 10 is shown in FIGS. 14–21. This tie 1100 comprises first 1200 and second 1400 laterally spaced-apart end trusses with an intermediate truss 1300 therebetween. Each end truss 1200, 1400 generally comprises a first vertical exterior strut 1250, 1450 with a second vertical interior strut 1260, 1460 laterally displaced therefrom. A pair of horizontal struts 1620, 1660 extend between the end struts 1250, 1450 and ends of the vertical interior struts 1260, 1460. The combination of these horizontal and vertical struts presents the primary configuration to the end trusses 1200, 1400 and intermediate truss 1300.

Vertically displaced from the respective horizontal struts 1620, 1660 are a second pair of horizontal struts 1630, 1650.

These struts 1630, 1650 cooperate with the above-described struts of tie 100 to present upper, lower and intermediate trusses within each primary truss 1200, 1300, 1400. The respective end trusses 1200, 1400 thus have lower and upper rectangular trusses 1210, 1230, 1410, 1430 with intermediate trusses 1220, 1420. The intermediate truss 1300 presents lower and upper trusses 1310, 1330 with intermediate truss 1320.

A pair of upper and lower diagonal struts 1600, 1610, 1700, 1710 extend between upper and lower ends of exterior struts 1250, 1450 and a corner of the upper trusses 1230, 1430 and lower trusses 1210, 1410 to provide reinforcement between the interior struts 1260, 1460 and exterior struts 1250, 1450 as well as the respective trusses 1200, 1400. A diagonal strut 1612 also extends through the middle truss 1320 of the intermediate truss 1300.

As above described, two bipartite molds are used for forming the sidewalls 12, 14 of the polymeric concrete form 10. Polystyrene beads are blown into the respective sidewall molds at a first temperature with the beads expanding upon cooling so as to fill the mold. Upon the beads being reheated at an elevated temperature, a second expansion occurs so that the foam fills the mold. Upon removal of the mold the sidewalls are presented.

Figure 14:
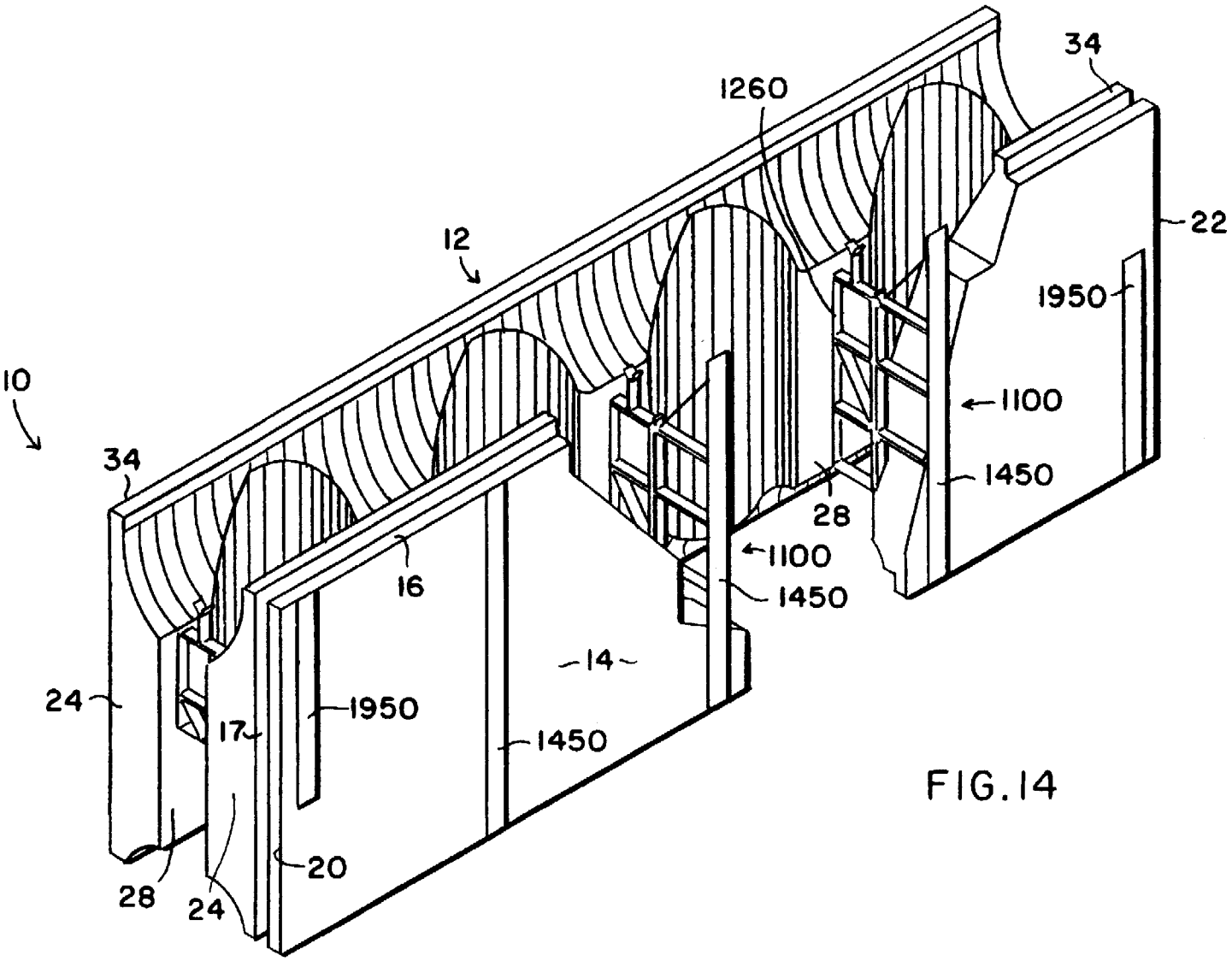
FIG. 14 is a perspective view of an alternative embodiment of a concrete form tie spanning first and second sidewalls of a concrete form with a portion of one sidewall of the form broken away to show an end truss of the tie embedded therein.
Figure 15:
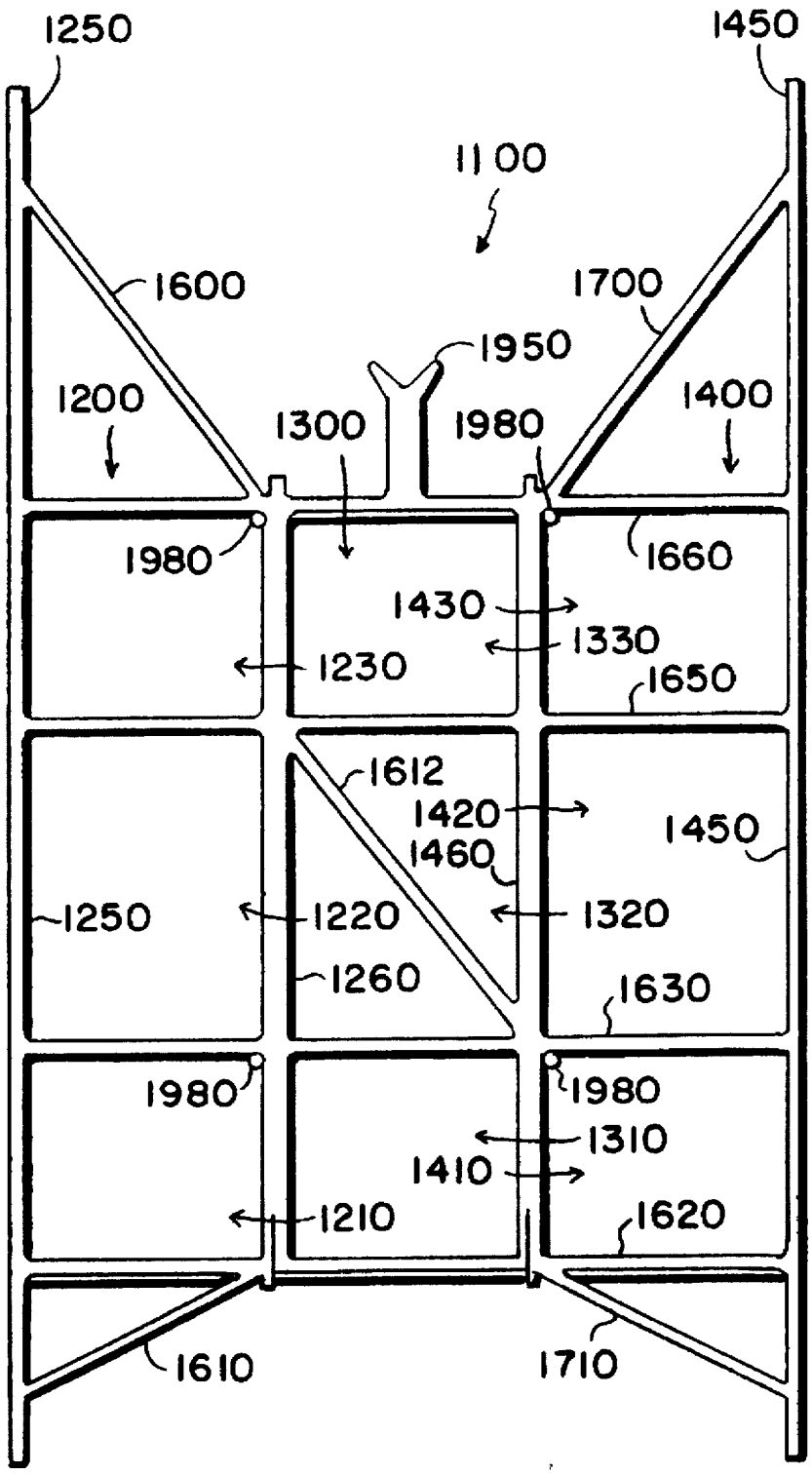
FIG. 15 is an elevation view of the alternative embodiment of a form tie shown in FIG. 14.
Figure 16:
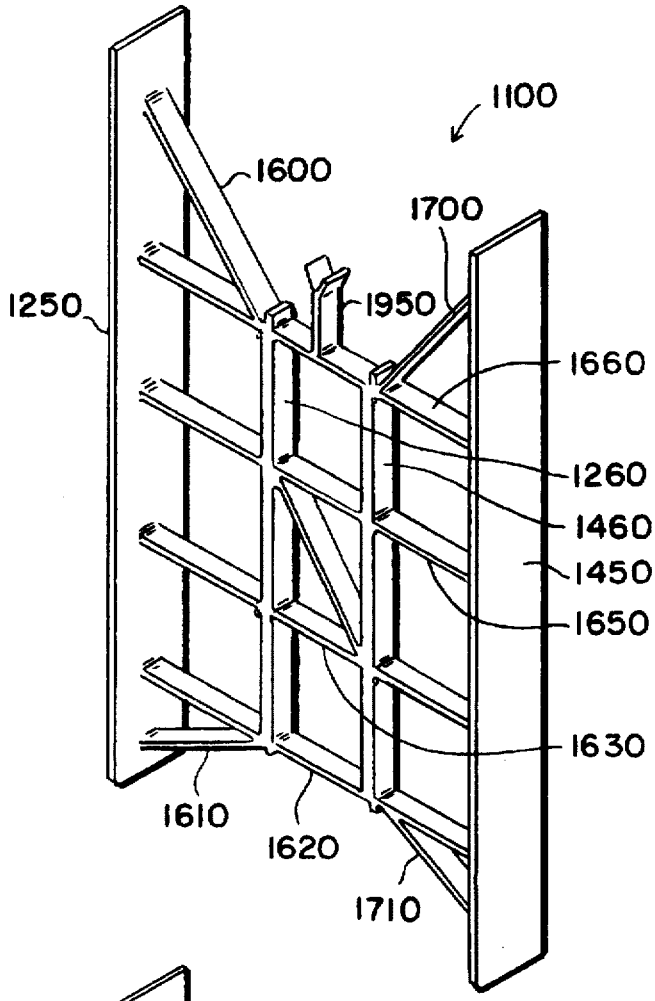
FIG. 16 is a perspective view of the form tie of FIG. 15.

Again, in response to the earlier-identified mold problem the interior vertical struts 1260, 1460 are configured to seal the mold openings which allow the end trusses 1200, 1400 to extend into the molds. Also, the exterior struts 1250, 1450 seal openings on the outside of the mold. (A plurality of nipples 1980 act as guides to assist the mold operator in aligning the tie 1100 within the mold openings.) Thus, the struts 1250, 1260, 1450, 1460 preclude escape of the expanding polystyrene foam from the mold. The results of a proper sealing are as shown in FIG. 14 as the opposed faces of these struts 1260, 1460 are not covered by foam. Furthermore, the exterior faces of struts 1250, 1450 are generally flush with the exterior surfaces of the respective sidewalls 12, 14. The distance between these interior struts 1260, 1460 define the width of the intermediate web 1300 and thus the resulting lateral displacement between the interior surfaces of the sidewalls 12, 14. Accordingly, the width of the resulting concrete pier within cavity 30 is likewise predetermined. Accordingly, the coplanar relationship of the struts 1250, 1260, 1450, 1460 with the exterior and interior faces of the sidewalls present a visual gauge of a common lateral displacement between the sidewalls 12, 14 of all forms. If not, i.e. the struts extend below or beyond the sidewalls, the form 10 sidewalls 12, 14 have an undesirable lateral displacement and should be discarded prior to use.

The intermediate truss 1300 fixes and maintains a desired lateral distance between the facing vertical surfaces of the partition sidewalls 28 of the form 10. This common lateral modularity also assures the builder that the stacked forms 10 will present even exterior surfaces as presented by the exterior surfaces of the sidewalls.

Figure 19:
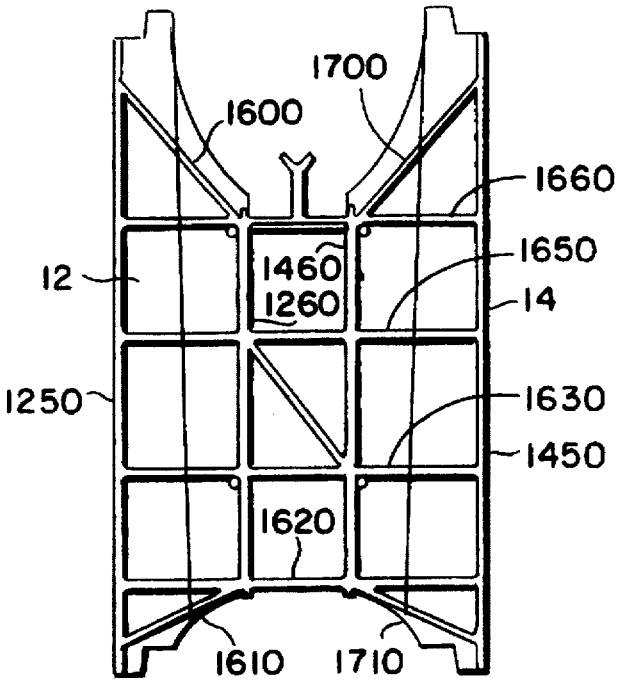
FIG. 19 is an end view of a concrete form tie of FIG. 14 with the sidewalls of the form removed from one side of the form tie to show the form tie in place.

As best shown in FIGS. 14 and 19, the end trusses 1200, 1400 span the lateral extent of the sidewalls 12, 14 of the form 10 as the end struts 1250, 1450, 1260, 1460 are coplanar with the exterior and interior faces of the sidewalls 12, 14. This strut/sidewall relationship effectively resists any forces acting on the sidewalls 12, 14 which may disrupt the monolithic structure and spatial relationship of the form sidewalls. Stress forces acting throughout the sidewalls are resisted by the outside struts 1250, 1450 as positioned relative to the sidewall 12, 14. Moreover, the diagonal struts 1600, 1610, 1700, 1710 further rigidify the end trusses 1200, 1400 so as to resist any twisting, turning, bending, etc of the trusses and struts therein due to forces acting on the form sidewalls 12, 14.

Figure 17:
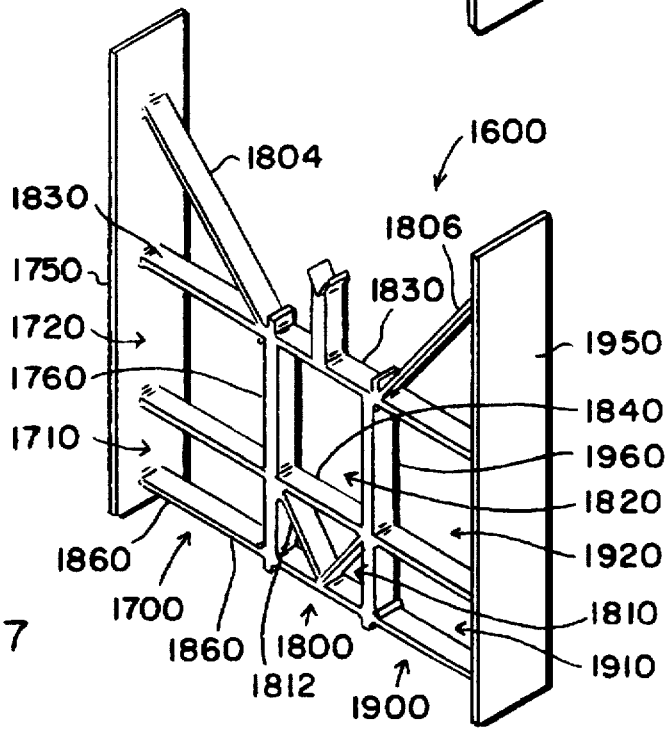
FIG. 17 is a perspective view of an alternative form of the concrete tie of FIG. 14 for use adjacent the ends of a concrete form.
Figure 18:
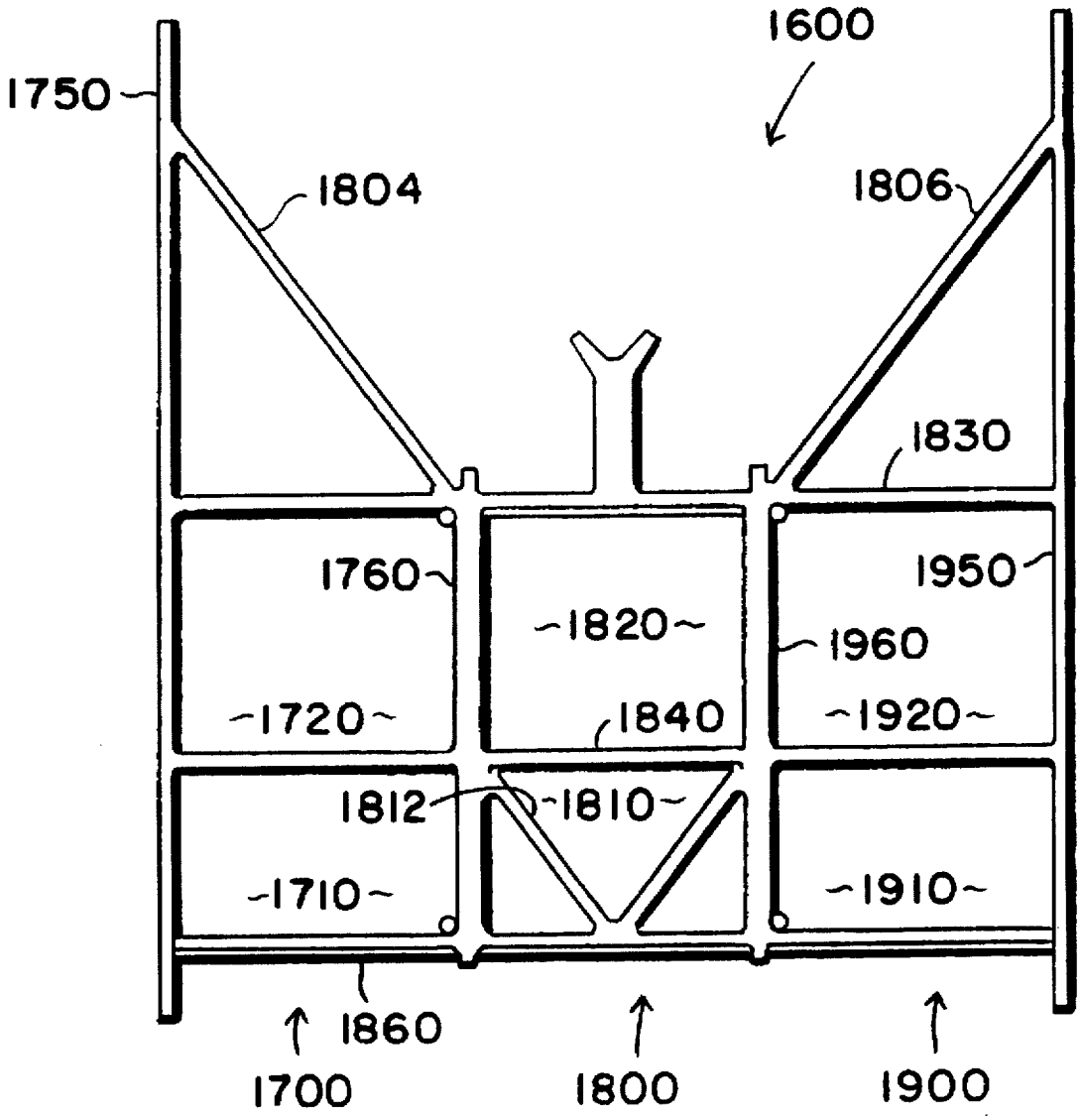
FIG. 18 is an elevation view of the tie of FIG. 17.

End ties 1600 are as shown in FIGS. 17 and 18. Each end tie 1600 comprises first 1700 and second 1900 end trusses with an intermediate truss 1800. Each end truss 1700, 1900 comprises a first elongated vertical strut 1750, 1950 relative to a second smaller vertical strut 1760, 1960 laterally displaced therefrom. A horizontal strut 1830 extends between the end struts 1750, 1950 and intermediate vertical struts 1760, 1960. A lower horizontal strut 1860 extends between these struts at the lower end thereof. An intermediate horizontal strut 1840 extends between these vertical struts. Extending from the upper end of each strut 1750, 1950 and towards a corner of the intersection of struts 1760, 1960 and horizontal strut 1830 are diagonal struts 1804, 1806. Thus, the struts, as above described, present the primary trusses 1700, 1800, 1900. Each end truss 1700, 1900 further presents lower 1710, 1910 and upper 1720, 1920 trusses. The web 1800 also has lower 1810 and upper 1820 truss sections with the lower truss 1810 having a V-shaped diagonal 1812 therein. The truss arrangement of tie 1600 is generally one-half the dimension of the truss arrangement of tie 1100 except for the exterior vertical struts 1950, 1960.

Figure 20:
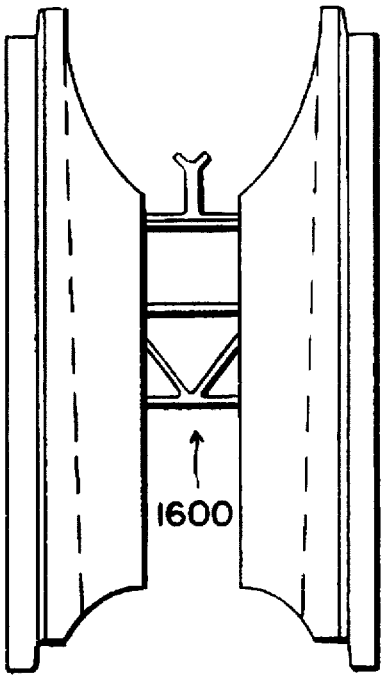
FIG. 20 is an end view of a concrete form showing the form tie of FIG. 18 in place.
Figure 21:
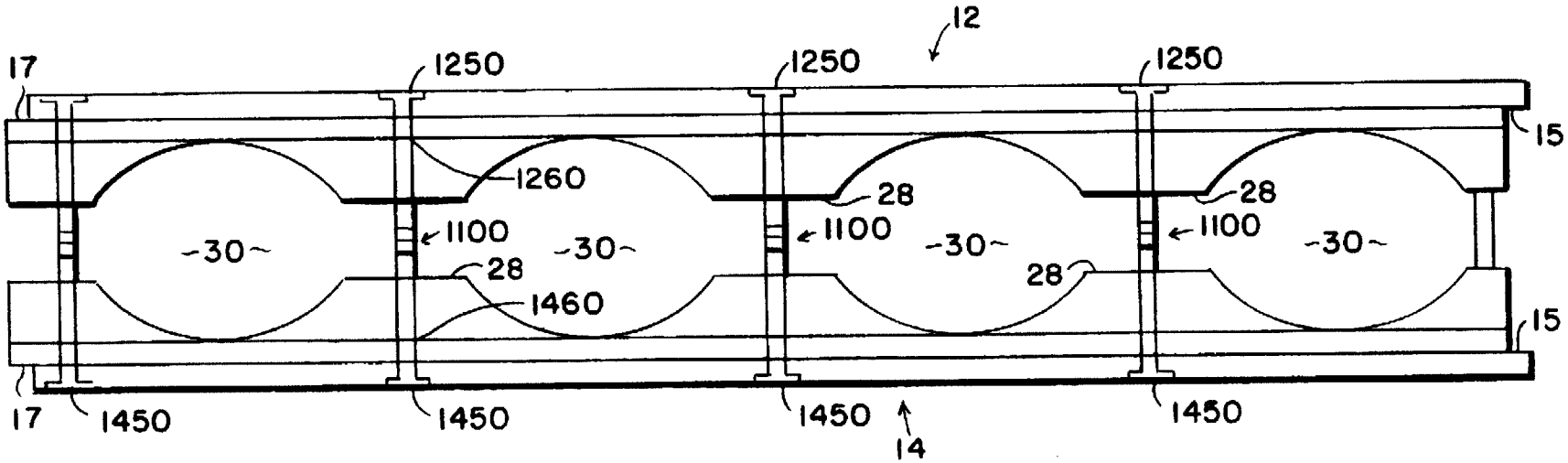
FIG. 21 is a diagrammatic top view of a concrete form tie showing the form ties of FIGS. 14 and 17 spanning the sidewalls of the concrete form.

As shown in FIGS. 14, 20 and 21 the end tie 1600 at one end of the form is positioned such that the top strut 1830 of end tie 1600 is generally aligned with the top strut 1660 of an adjacent tie 1100. At the opposed end of the form the bottom strut 1860 of tie 1600 is generally aligned with the bottom strut 1620 of an adjacent tie 1100. Upon a first form 10 being connected with a longitudinally adjacent second form, a pair of form ties 1600 will be longitudinally adjacent but vertically offset from one another. These vertically offset ties 1600 are utilized in lieu of the full length ties 1100 to enhance the flow of concrete between longitudinally adjacent forms 10. Also, the end ties 1600 strengthens the vertical joint formed by connected forms so as to diminish "blow out" therealong.

The primary and secondary rectangular trusses of the ties 1100, 1600, as above described, resist tension, compression, bending, twisting and lateral forces acting thereon during transport as well as during concrete pouring and curing.

Such trusses are reinforced by the position of the exterior struts 1250, 1450, 1750, 1950 as well as the diagonal struts 1600, 1610, 1700, 1710, 1804, 1806. These diagonal struts enhance the maintenance of the overall configuration of the ties 1100, 1600, as well as the primary and the secondary trusses therein. Moreover, the diagonal struts of each tie 1100, 1600 as embedded in the form material, present additional bearing surfaces which resist the various forces acting on the form. Thus, the vertical, lateral and longitudinal forces acting on the form faces during transport and subsequent use are resisted so as to maintain the desired spatial relationships/modularities of the form sidewalls 12, 14.

The relatively larger width of the outside 1250, 1450, 1750, 1950 struts presents an enlarged bearing surface to the surrounding foam. This coplanar relationship with the sidewall surface not only enhances the resistance to twisting of the form 10 in the face of stresses acting thereon but also enhances the resistance against pressures resulting from concrete being poured between the form sidewalls 12, 14. Thus, shifting of the sidewalls 12, 14 of the form 10 is precluded.

Tie 1100 also presents a seat 1950 extending from the upper horizontal strut 660 for receiving a portion of horizontal rebar (not shown) therein. Upon rebar placement vertical rebar is extended through the respective cavities, offset from the centerline and tied to the horizontal rebar.

It is to be understood that while certain forms of this invention and dimensions have been illustrated and described, it is not limited thereto except insofar as such limitations are included in the following claims and allowable functional equivalents thereof.

Having thus described the invention, what is claimed as new and desired to be secured by Letters Patent is as follows:

1. A form tie for maintaining a desired spatial relationship between first and second facing sidewalls of a concrete form comprising:

first and second end trusses with an intermediate web therebetween, each end truss adapted to lie within a respective sidewall and comprising:

first and second laterally spaced-apart vertical struts, said first strut having upper and lower ends and adapted to vertically extend between upper and lower edges of an exterior surface of a sidewall and beyond an upper and lower end of said second strut, said second strut adapted to vertically extend between upper and lower edges of an interior surface of a sidewall of a panel;

a first pair of vertically spaced-apart horizontal struts extending between said upper and lower ends of said second strut and said first vertical strut to form a primary rectangular truss in combination with said vertical struts, said upper and lower ends of said first strut extending beyond said rectangular truss;

a second pair of vertically spaced-apart horizontal struts disposed between said struts of said first pair of horizontal struts and extending between said first and second vertical struts to form within said primary rectangular truss a pair of secondary upper and lower rectangular trusses with an intermediate truss therebetween;

at least one diagonal strut extending from each upper and lower end of said first strut to each upper and lower end of said second strut;

said web intermediate said first and second end trusses and adapted to extend between facing interior surfaces of first and second sidewalls of a form and comprising:

at least a first pair of vertically spaced-apart horizontal struts extending between said second struts of each end truss to form at least one rectangular truss intermediate said first and second primary end trusses;

a second pair of vertically spaced-apart horizontal struts disposed between said struts of said first pair of horizontal web struts and extending between said vertical second struts to form a pair of secondary upper and lower rectangular trusses with an intermediate truss therebetween;

each end truss being adapted to lie within a respective sidewall with said web adapted to extend between interior surfaces of the facing sidewalls of the form, whereby said tie maintains the sidewalls in place.

2. The device as claimed in claim 1 wherein said second strut of each end truss is adapted to lie coplanar with an interior surface of each sidewall.

3. The device as claimed in claim 2 wherein said first strut of each end truss is adapted to lie coplanar with an exterior surface of each sidewall whereby said first and second struts of each end truss bound lateral extents of a sidewall therebetween to resist forces acting thereon.

4. The device as claimed in claim 1 further comprising:

a seat projecting from a horizontal strut of said web, said seat adapted to support a rebar therein.

5. A form tie for maintaining a desired spatial relationship between ends of first and second facing sidewalls of a concrete form comprising:

first and second laterally spaced-apart end trusses with an intermediate web truss therebetween, each end truss adapted to lie within a respective sidewall and comprising:

first and second laterally spaced-apart vertical struts, each second vertical strut adapted to have a length of approximately one-half a height of an interior surface of an adjacent sidewall and adapted to vertically extend therealong, said first vertical strut being longer than said second vertical strut and adapted to extend along an exterior surface of a sidewall with upper and lower ends of said first strut positioned respectively above and below said upper and lower ends of said second strut;

at least a pair of horizontal struts extending between said first and second vertical struts to form at least one rectangular truss in combination with said first and second vertical struts;

at least one strut diagonally extending between said upper and lower ends of said first strut and said upper and lower ends of said second strut;

a web intermediate said first and second end trusses comprising:

at least a pair of horizontal struts extending between said adjacent struts of each end truss to form at least one rectangular truss intermediate said first and second end trusses;

each end truss adapted to lie within the respective sidewall of the form with said first strut generally adjacent an exterior surface of said sidewall and said second strut generally adjacent an interior surface of each sidewall, said web extending between interior surfaces of the sidewalls of the form, whereby to maintain the sidewalls in place.

6. The device as claimed in claim 5 wherein each end truss further comprises an intermediate horizontal strut extending between said first and second vertical struts and between said pair of horizontal struts, said intermediate strut forming upper and lower trusses within said at least one rectangular truss.

7. The device as claimed in claim 6 wherein said web further comprises an intermediate horizontal strut extending between said first and second vertical struts, said intermediate web strut forming upper and lower trusses, said at least one diagonal strut extending through said upper or lower trusses of said web.

8. A form tie for maintaining a desired spatial relationship between first and second facing sidewalls of a concrete form comprising:

first and second end trusses, each end truss adapted to lie within a respective sidewall and comprising:

first and second laterally spaced-apart vertical struts, said first strut having upper and lower ends adapted to vertically extend adjacent an exterior surface of a sidewall between upper and lower edges of an exterior surface of a sidewall and beyond an upper and lower end of said second strut, said second strut adapted to vertically extend adjacent an interior surface of a sidewall of a panel;

a first pair of vertically spaced-apart horizontal struts extending between upper and lower ends of said second strut and said first vertical strut to form a primary rectangular truss in combination with said vertical struts, said upper and lower ends of said first strut extending beyond said rectangular truss;

at least one diagonal strut extending from each upper and lower end of said first strut to each upper and lower end of said second strut;

means for connecting said second struts of each end truss;

each end truss being adapted to lie within a respective sidewall with said connecting means adapted to extend between said second struts and the facing sidewalls of the form whereby said tie maintains the sidewalls in place.

9. The device as claimed in claim 8 wherein said second strut of each end truss is adapted to lie coplanar with an interior surface of each sidewall.

10. The device as claimed in claim 9 wherein said first strut of each end truss is adapted to lie coplanar with an exterior surface of each sidewall whereby said first and second struts of each end truss bound lateral extents of a sidewall therebetween to resist forces acting thereon.

11. A form tie for maintaining a desired spatial relationship between ends of first and second facing sidewalls of a concrete form comprising:

first and second laterally spaced-apart end trusses with an intermediate web truss therebetween, each end truss adapted to lie within a respective sidewall and comprising:

first and second laterally spaced-apart vertical struts, each second vertical strut adapted to have a length of approximately one-half a height of an interior surface of an adjacent sidewalls and adapted to extend therealong, said first vertical strut being longer than said second vertical strut and adapted to extend along an exterior surface of a sidewall;

at least a pair of horizontal struts extending between said first and second vertical struts to form at least one rectangular truss in combination with said vertical struts;

at least one strut diagonally extending between each end of said first strut and each end of said second strut;

means for connecting said second struts of said first and second end trusses;

each end truss adapted to lie within the respective sidewall of the form with said first strut generally adjacent an exterior surface of said sidewall and said second strut generally adjacent an interior surface of each sidewall, said connecting means extending between interior surfaces of the sidewalls of the form, whereby to maintain the sidewalls in place.

* * * * *